United States Patent [19]

Tarozzi et al.

[11] Patent Number: 4,667,484

[45] Date of Patent: May 26, 1987

[54] COOLER WITH POCKETED LID

[75] Inventors: Richard A. Tarozzi, Gales Ferry; Charles Formhals, Ledyard, both of Conn.

[73] Assignee: King-Seeley Thermos Company, Norwich, Conn.

[21] Appl. No.: 810,272

[22] Filed: Dec. 18, 1985

[51] Int. Cl.[4] ..... F25D 3/08

[52] U.S. Cl. ..... 62/371; 62/457; 220/23; 220/85 H

[58] Field of Search ..... 220/23, 3.1, 85 H; 62/457, 458, 371

[56] References Cited

U.S. PATENT DOCUMENTS

| | | | |
|---|---|---|---|
| 2,767,039 | 10/1956 | Danna, Jr. | 220/23 X |
| 3,678,703 | 7/1972 | Cornish et al. | 62/371 |
| 3,791,547 | 2/1974 | Branscum | 62/371 X |
| 3,979,007 | 9/1976 | Thornbloom, Jr. | 220/23 |
| 4,537,044 | 8/1985 | Putnam | 62/371 |

*Primary Examiner*—Lloyd L. King

*Attorney, Agent, or Firm*—Harness, Dickey & Pierce

[57] ABSTRACT

A portable cooler and removable lid therefor in which the lid is formed with a cavity for receiving articles and carrying them independently of the cooler body. A pivotally supported closure member is carried by the lid for closing its cavity and retaining articles within it.

6 Claims, 9 Drawing Figures

COOLER WITH POCKETED LID

BACKGROUND OF THE INVENTION

This invention relates to a cooler having a pocketed lid and more particularly to an improved lid construction for portable coolers or the like.

The uses of portable coolers are well known. Frequently, the cooler is utilized in such an environment that the user may carry no other article with him. For example, it is common to use portable coolers at the beach or in connection with other sporting activities wherein the user may be dressed in such a way that his clothing does not afford sufficient capacity to carry all of the personal articles which the user may wish to bring with him. For example, at the beach, a user may wish to bring sunglasses, suntan lotion, reading materials and various other paraphernalia which cannot be conveniently carried in the small pockets, if any, of a swimming suit or beach robe. The cavity of the cooler, although large enough to accommodate such articles, is not suited for this purpose due to the fact that it is normally filled with ice and liquid.

It is, therefore, a principal object of this invention to provide an arrangement whereby a cooler may be utilized to carry such articles without their becoming damaged due to contact with the water in the cooler.

It is a further object of this invention to provide a lid for a portable cooler that provides a storage cavity in which articles may be carried which are not desired to be refrigerated.

SUMMARY OF THE INVENTION

This invention is adapted to be embodied in a lid for forming a closure for a portable cooler or the like which has a body portion that defines an article receiving cavity and an opening for access to the cavity. The lid has a lower surface that is complementary in size and shape to the cooler opening for forming a closure therefor. An upper surface is spaced from the lower surface and the lid defines a cavity. The upper lid surface defines an opening for access to the lid cavity so that articles may be placed within the lid cavity. A closure member is carried by the lid and movable between a closed position whereby the lid opening is closed and articles may be confined within the lid cavity and an opened position wherein the lid opening is opened and articles may be placed within or removed from the lid cavity.

DETAILED DESCRIPTION OF THE PREFERRED EMBODIMENT

Figure 1:
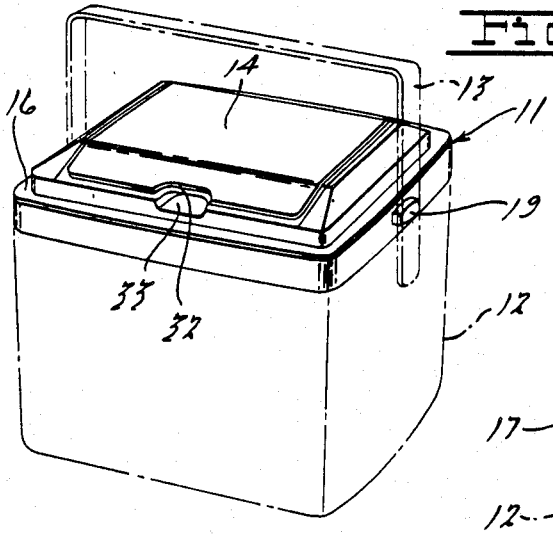
FIG. 1 is a perspective view of a lid for a portable cooler constructed in accordance with an embodiment of the invention and in place in one position on the cooler with the cooler carrying handle being in the carrying position. The cooler is shown in phantom.
Figure 2:
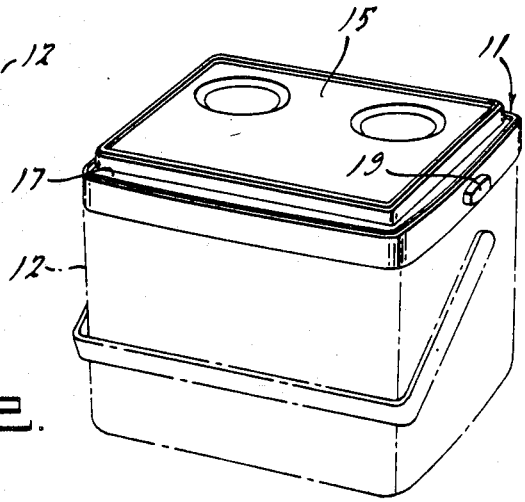
FIG. 2 is a perspective view, in part similar to FIG. 1, showing the lid in an inverted position and the carrying handle in the non-carrying condition. Again, the cooler is shown in phantom.
Figure 3:
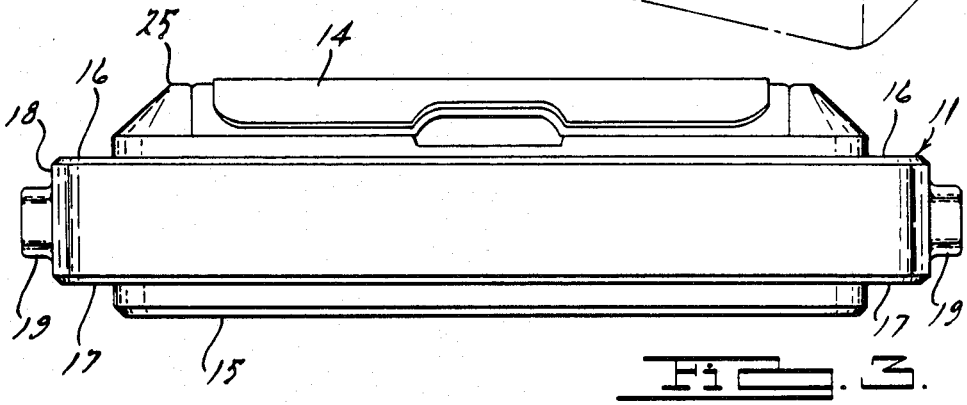
FIG. 3 is an enlarged, side elevational view of the lid.
Figure 4:
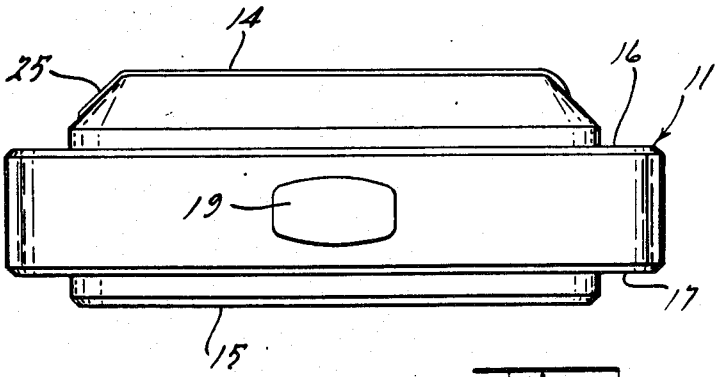
FIG. 4 is an enlarged, end elevational view of the lid.
Figure 5:
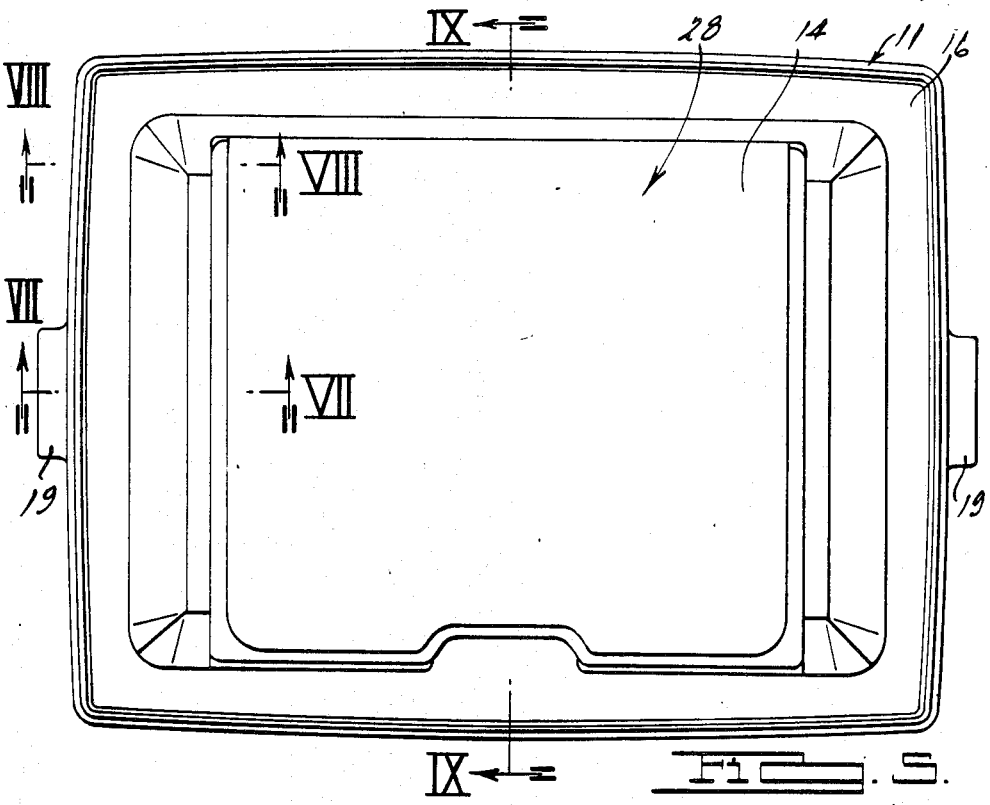
FIG. 5 is an enlarged, top plan view of the lid.
Figure 6:
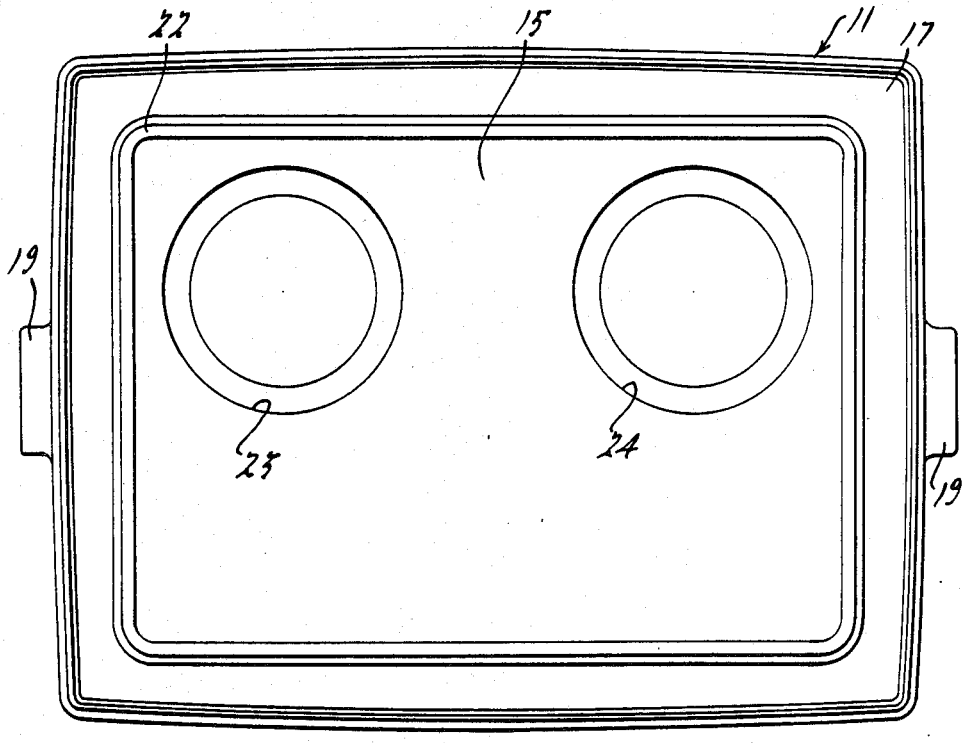
FIG. 6 is an enlarged, bottom plan view of the lid.

Referring first to FIGS. 1 and 2, a lid constructed in accordance with an embodiment of the invention is identified generally by the reference numeral 11. The lid 11 is adapted to be used in conjunction with a portable cooler, which is shown in phantom and which is identified by the reference numeral 12. The cooler 12 may be of any suitable configuration and is formed with an internal cavity in which articles may be placed. The cooler 12 has an opening formed in its upper face which opening is adapted to be closed by the lid 11. In addition, a carrying handle 13 is pivotally supported by the body portion of the cooler 12 and carries lugs or latching devices that cooperate with lugs formed on the lid 11 for locking the lid 11 in position on the cooler 12 in which it forms a closure for the opening of the cooler 12. As will become apparent, the lid is configured so that it may be positioned on the cooler 12 with either its upper side 14 (FIG. 1) facing up or its lower side 15 (FIG. 2) facing up. As will become apparent, the upper and lower sides 14 and 15 are configured differently for a purpose which will be described.

Referring now additionally to the remaining figures, the upper and lower sides 14 and 15 are each formed with peripheral flanges 16 and 17, respectively, which ledges are adapted to engage and seat upon an upper surface of the cooler 12 around its opening. The peripheral flanges 16 and 17 are spaced apart and a marginal edge 18 extends between the flanges 16 and 17. On two sides of the marginal flange 18, there are formed a pair of locking lugs 19. The lugs 19 extend outwardly from the flange 18 and have curved upper and lower surfaces that are equally spaced and symmetric about a plane passing through the center of the lugs 19 and equal distance from the flanges 16 and 17. These curved surfaces are engaged by locking members carried by the handle 13 when the handle 13 is in its raised carry position (FIG. 1) so as to lock the lid 11 on the cooler 12.

A raised area 21 is formed on the lower lid side 15 and is surrounded by the flange 17. The raised area 21 is configured so as to fit within the opening formed by the upper portion of the cooler body 12 so as to afford a seal and also so as to centralize the lid 11 on the body 12. The surface of the raised portion 21 is surrounded by a peripheral flange 22 so as to function like a tray. In addition, circular depressions 23 and 24 may be formed within the area bounded by the flange 22 so as to accommodate glasses, bottles or the like and to hold them against lateral shifting.

The upper lid side 14 is also provided with a raised central area 25 that is bounded by the peripheral flange 16 and which is configured to fit within the opening of the cooler body 12 when the lid face 14 faces the cavity of the cooler. The raised portion 25 is formed with a central opening 26 that affords access to a cavity 27. The cavity 27 may be formed by a depression in the upper lid surface 14 or, alternatively, may be formed by a separate member, or merely may just be a general cavity formed by the opening 26. The cavity 27 has, however, sufficient depth so as to hold a number of personal articles such as sunglasses, suntan lotion, keys and the like.

Figure 8:
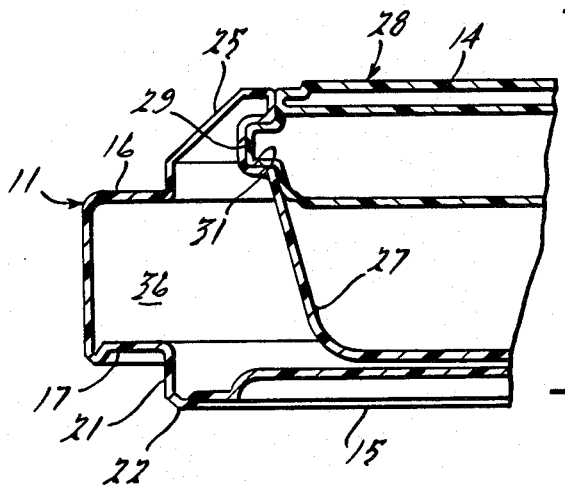
FIG. 8 is an enlarged, cross-sectional view taken along the line 8—8 of FIG. 5.
Figure 9:
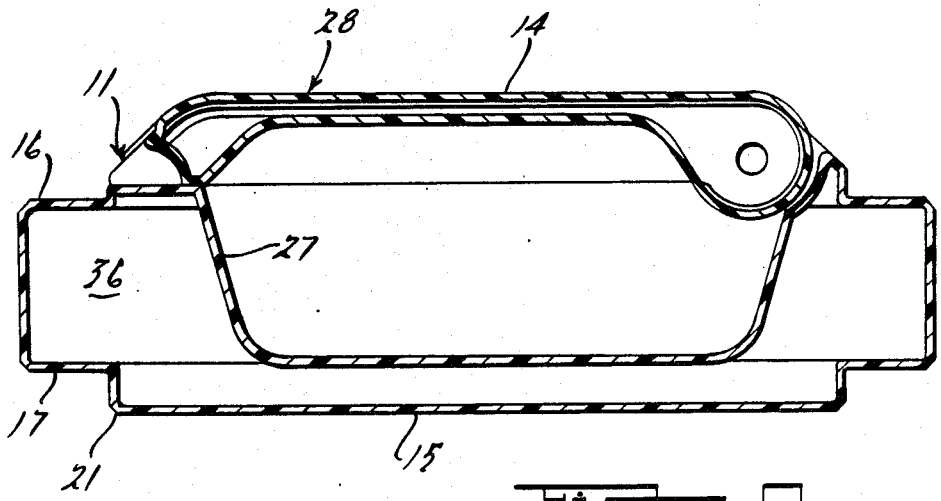
FIG. 9 is a cross-sectional view taken along the line 9—9 of FIG. 5.

A closure, indicated generally by the reference numeral 28, is carried by the lid 11 for closing the opening 26 and retaining articles within the cavity 27. As may be seen in FIG. 8, one peripheral edge of the lid 28 is formed with a pair of outwardly extending cylindrical bosses 29 that are adapted to be received within corresponding openings 31 formed by the lid portion 25 for pivotally connecting the closure member 18 to the remainder of the lid body so that the closure member 28 may be pivoted between an opened position affording access to the cavity 27 and a closed position wherein it functions as a closure for this cavity. The lid 28 is formed with a hand grip recess 32 at the side opposite to the projections 29 which is accessible through a corresponding recess 33 formed in the raised portion 25 so that a user may grasp the lid 28 and conveniently pivot it between an opened position and a closed position.

Figure 7:
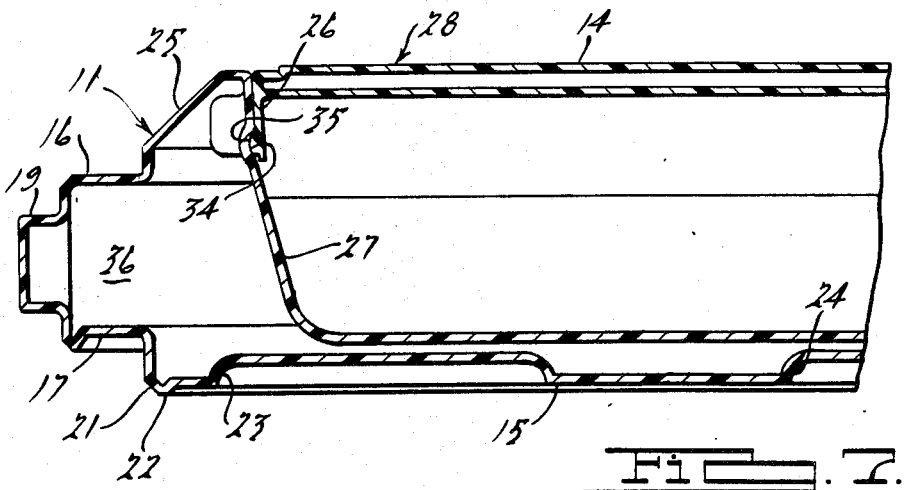
FIG. 7 is a further enlarged, cross-sectional view taken along the line 7—7 of FIG. 5.

The raised portion 25 is also provided with an indented area 34 (FIG. 7) on one side of the cavity 27 into which a corresponding projection 35 of the lid 28 is received when the lid 28 is in its closed position so as to serve a latching function. This projection 35 of the lid 28 is formed on a cantilevered flange and is sufficient resilient so as to permit it to snap into and out of engagement with the recess 34.

The lid 11 and its closure 28 may be formed from any suitable material such as a blow molded plastic. In addition, a cavity 36 that is formed between the upper and lower portions 14 and 15 may be filled with some insulating material if desired.

It should be readily apparent that the described lid construction serves a dual purpose as a closure for the cooler 12 and additionally as a separate article carrier that can carry articles independently of the cavity of the main cooler body. In addition, the lid 12 is configured so that it can be placed either side up so as to afford access to the lid cavity 27 or so as to conceal it and place the tray portion 15 upwardly for its use.

Although an embodiment of the invention has been illustrated and described, various changes and modifications may be made, without departing from the spirit and scope of the invention, as defined by the appended claims.

We claim:

1. A lid for forming a closure for a portable cooler having a body portion defining an article receiving cavity and an opening for access to said cavity defined by a horizontally extending ledge, said lid having a lower surface complementary in size and shape to said opening for forming a closure therefor, an upper surface spaced from said lower surface, said upper and lower surfaces each being provided with raised central areas surrounded by a peripheral flange, said peripheral flange being adapted to be supported on the cooler body ledge with the raised central portion being adapted to extend into the cooler body cavity, a cavity defined within said lid and sized to receive articles, said upper surface defining an opening for access to said lid cavity, a closure member carried by said lid and freely movable between a closed position wherein said lid opening is closed and articles may be confined with said lid cavity and an opened position wherein said lid opening is opened and articles may be placed within or removed from said lid cavity and latching means for releasably retaining said closure member in its closed position.

2. A lid as set forth in claim 1 further including latching means between the lid and the closure member for latching the closure member in its closed position.

3. A lid as set forth in claim 1 wherein the lower surface is configured as a tray.

4. A lid as set forth in claim 3 wherein the lid is adapted to be reversibly supported on the cooler with either its lower face or its upper face facing the cooler cavity.

5. A lid as set forth in claim 4 further including latching means carried by the lid and cooperable with cooperating latching means on the cooler for latching the lid to the cooler in either of its positions.

6. A lid as set forth in claim 1 wherein the closure member is pivotally supported by the lid.

* * * * *